United States Patent [19]

Marquardt et al.

[11] 3,982,086

[45] Sept. 21, 1976

[54] ELECTRICAL SWITCH CONSTRUCTION

[75] Inventors: Erich Marquardt; Werner Storz, both of Rietheim; Eckehardt Sachs, Spaichingen, all of Germany

[73] Assignee: Firma J. & J. Marquardt, Germany

[22] Filed: May 8, 1975

[21] Appl. No.: 575,531

[30] Foreign Application Priority Data

May 13, 1974 Germany ..... 2423075

[52] U.S. Cl. ..... 200/67 DA; 200/76

[51] Int. Cl.[2] ..... H01H 13/36

[58] Field of Search ..... 200/67 DA, 67 DB, 67 D, 200/76, 67 A

[56] References Cited

UNITED STATES PATENTS 2,464,244 2/1949 Wise ..... 200/67 DB

*Primary Examiner*—David Smith, Jr.

*Attorney, Agent, or Firm*—McGlew and Tuttle

[57] ABSTRACT

An electrical switch, comprises a housing having spaced apart side walls each with a bearing recess which is located above spaced apart fixed contacts. An actuator is guided in the housing between the side walls and moves toward the fixed contacts to move first leg portions of substantially U-shape contact springs to flex these leg portions and pivot intermediate web portions which are pivotal in the bearing recesses and, thereafter, snap second leg portions into engagement with the fixed contacts. The arrangement may include two sets of spaced apart contact members between which the second leg portions of the leaf springs are movable and the first leg portions are preferably pivotally connected between depending feet of the actuating member. The second leg portions include curved recesses located below the feet which are similarly curved so that the feet engage into the recesses and move these leg portions before the second leg portions are snapped into a contact engagement with one or the other of the fixed contact members.

9 Claims, 2 Drawing Figures

ELECTRICAL SWITCH CONSTRUCTION

FIELD AND BACKGROUND OF THE INVENTION

This invention relates in general to the construction of electrical switches and, in particular, to a new and useful electric switch having a pair of substantially U-shape spring members with first leg portions which are pivotally connected together and intermediate portions which pivot in bearing recesses of a housing so that, upon movement of the first leg portions by an actuator, second leg portions are snapped toward engagement or away from engagement with a fixed contact.

DESCRIPTION OF THE PRIOR ART

The present invention deals particularly with electrical switches which include two contacts to be bridged and which also include a switching bridging member and an actuating member. Switches of this kind are well known, particularly in a design where they are used with pushbutton actuators. However, their construction is relatively complicated so that not only the manufacturing costs of the component parts, but also, the costs of assemblage are relatively high.

SUMMARY OF THE INVENTION

The present invention is directed to a switch which is constructed so as to permit a particularly inexpensive manufacture. To this effect, the switch is provided with a bridging or a spring contact of substantially U-shape configuration in the form of a U-shape or V-shape leaf spring which have first legs which are pivotally connected to each other and second legs which are designed as contact arms and which swing into a contact-making or contact-breaking position by engagement of the first legs with an actuating member to cause pivotal movement of their intermediate web portions in bearing recesses of a housing. After the two leaf springs are interconnected, they form a mounting unit which can be inserted into a corresponding cavity of the housing and their U-shape intermediate web portions may be easily fitted into recesses defined in corresponding side walls of the housing so that the two elements are disposed in opposition and their first leg portions join between depending feet of an actuating member. The construction makes alignment within the housing and in respect to the actuating member a very simple task.

In a particularly preferred embodiment of the invention, the contact arms are pressed in their first switching position against a stop and, in their other switching position, the respective associated contact arms are moved into a switching position engaged with a fixed contact. The springs may be easily installed in the housing by merely inserting the intermediate U-shape portions within the cut-out bearing recesses defined in associated walls of the housing. During the initial movement of the actuator against the first leg portions, these leg portions are flexed so as to load the spring for the final movement during which the second leg portion is snapped over to either an actuated position or a deactuated position or a first and second actuated position. Instead of the stop, two fixed contacts may be associated with each second arm portion of each spring. In this case, the movable contacts must be firmly pressed into contact with the respective fixed contact in any switching position, and this is ensured by the resilient characteristics of the leaf springs themselves.

Advantageously, the first leg portions of the leaf springs are curved and they form downwardly extending curved recesses below depending actuator member feet which have similarly curved end faces so that the curved end faces easily engage in the recesses to cause a flexing of the first arm portions. For such a construction, the middle of the arc of the first leg portions coincide substantially with the curvature of the depending legs or feet of the actuator. With such a construction, it is not necessary to provide the contact arm with a contact stud or the like, but rather, the respective leg may cooperate directly with the contact to be bridged.

In accordance with a feature of the invention, the two leaf springs are formed with first leg portions having free ends which are formed with comb-like teeth so that the respective ends of the adjacent spring contacts may be pivotally interengaged by interengagement of the comb-like teeth. Thus, no special pivot construction need be provided but the connection between the spring contacts themselves form the necessary hinge so that the springs may be assembled very simply and with small expense. The necessary contact pressure in the bearing assembly to keep the two spring contacts in interengagement is provided by the spring elements themselves in the mounting construction wherein the intermediate portion is engaged in a bearing recess of the housing wall.

In a particular embodiment of the invention, the elements of the edge bearing joint formed between the two springs, considered in the direction of the width of the springs, include a comb-like tooth formation on one spring which is aligned with a correspondingly formed recess on the other. The construction is such that the springs may be of identical design and may be mounted in the housing symmetrically. This feature also contributes substantially to the inexpensive manufacture of the switch because, in spite of the congruent but symmetrical positioning, two leaf springs can be used which are manufactured and shaped in the same manner.

The actuating member is preferably made so that it may reciprocate within the housing and it is adapted to be pushed inwardly against the action of a return spring. It is advantageously designed as a pushbutton. A return spring is necessary in cases where the switching mechanism formed by the two leaf springs is bistable and the necessity of a withdrawing of the actuating member is to be avoided. In a preferred embodiment of the invention, the two leaf springs form a bistable snap mechanism and the actuating member is provided with an angular reset element movable laterally alongside the leaf springs. The reset element, of course, must not hinder the pivotal movement of the leaf springs during the switching operation since this would impair, or even prevent, the snap effect. On the other hand, the reset element must be disposed so as to enable the mechanism to snap also during the resetting, and for this purpose, it must be sufficiently spaced from those portions of the actuating member which act on the leaf springs.

It is also very advantageous to use the free end portion of the reset element as a backrest for one end of the return spring and to apply the other end of the spring against the housing. The return spring may, for example, be a helical compression spring.

Accordingly, it is an object of the invention to provide an improved electric switch which includes a pair of substantially U-shape contact springs which have first leg portions which are pivotally connected together and which may be moved by an actuator so as to pivot intermediate web portions in respective bearing recesses of a housing and thereby move second leg portions toward and away from an actuating position in accordance with the direction of actuation movement.

A further object of the invention is to provide a switch construction which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

DESCRIPTION OF THE PREFERRED EMBODIMENT

Figure 1:
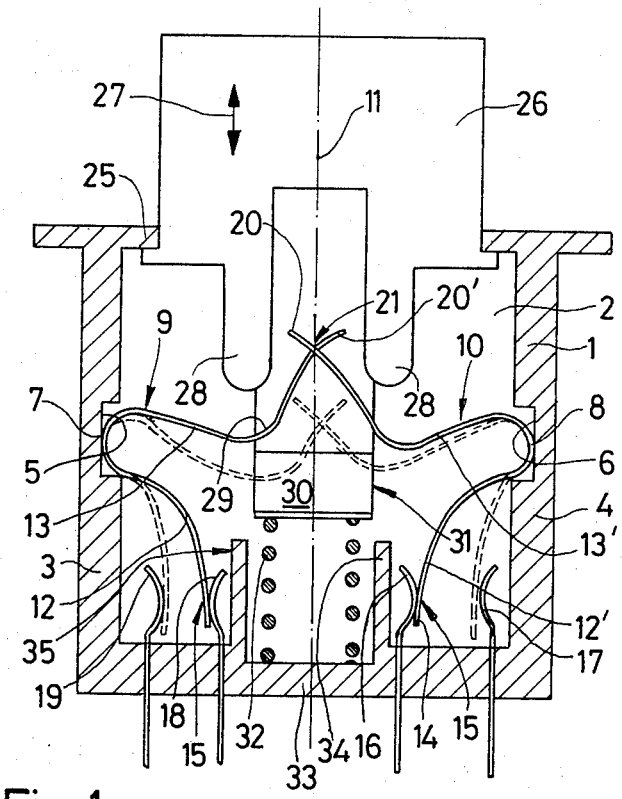
FIG. 1 is a diagrammatic vertical sectional view of a switch constructed in accordance with the invention.
Figure 2:
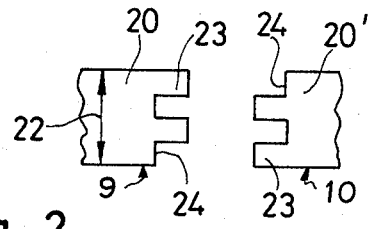
FIG. 2 is a partial separated top plan view showing the interengagement of the first leg portions of the leaf spring contacts.

Referring to the drawing in particular, the invention embodied therein, comprises an electrical switch, including a housing 1, which advantageously comprises a single injection molded part which can be closed by means of a cap placed thereover, but which is not shown. Housing 1 includes side walls 3 and 4 which are spaced apart and which carry respective opposite aligned bearing recesses 5 and 6.

In accordance with the invention, two substantially U-shape leaf springs or spring contacts, generally designated 9 and 10, of identical configuration, are mounted symmetrically and oppositely within the housing and in respect to a central plane 11 of the housing. Each of the springs 9 and 10 include first leg portions 13,13', second leg portions 12, 12', and intermediate web portions or U-shape connecting portions 7 and 8, respectively. Both leg portions 12 and 13 of each spring 9 and 10 are curved, so that the free ends of the legs extend in mutually opposite directions. Each second leg portion 12 and 12' includes a free end 14 which serves as a movable contact 15 which cooperates with one or both of two spaced apart contacts 16 and 17 which are mounted on a bottom wall on each side of a central upwardly extending sleeve portion 34. Removable contact parts 15 of the first spring member 9 is located between the fixed contacts 18 and 19 and the movable contact part 15 of the second contact 10 is located between the fixed contacts 16 and 17 on the opposite side of the sleeve 34.

In accordance with a feature of the invention, the first leg portions 13, 13' are formed with an intermediate curved portion 29 which is of the same curved configuration as the lower end of depending feet or legs 28, 28 of an actuating member 26 which is movable upwardly and downwardly in the housing between walls 2 and 3. The upper or free end portions 20 and 20' of springs, generally designated 9 and 10, are formed with interengageable teeth and recesses including tooth formations 23 which engage into correspondingly sized recesses 24. The interengagement forms an edge bearing or pivot 21 for the two spring contacts which ensures that they maintain together and are not offset laterally relative to each other.

In the switching position, which is shown in FIG. 1 of the drawing, the movable contacts 15 are firmly pressed against the contacts 16 and 18, respectively. At the same time, the U-shape middle portion 7, 8 applies, in the bearing recesses 5 and 6, respectively. In consequence, the free end portions 20, 20' are also pressed against each other so that the edge bearing formation 21 is held in a stable position. The actuating member 26 is designed as a push rod and is reciprocable in the directions of the double arrow 27. In the initial position of the actuator, the curved feet 28, 28 are spaced away from the curved portions 29 of the associated first arm portions of the respective spring contacts 9 and 10. Upon pushing actuator member 26 inwardly, the feet 28, 28 contact the first arm portions 13, 13' and push them in the direction of the fixed contacts in order to compress the arm portions and to increase the tension of the entire spring members 9 and 10. As soon as a certain maximum tension is produced, the spring contacts 9 and 10, which are held together through the edge bearing formation 21, jump into the second switching position, which is indicated in dotted lines and connect thereby, the fixed contacts 17 to the fixed contact 19. This position is also a stable position for the switching mechanism ensuring a correspondingly high contact pressure.

In order to return spring contacts 9 and 10 into their initial position, the actuating member 26 is biased into a withdrawn or nonactuated position by means of a coil compression spring 32 which is fitted into the sleeve extension 34 and which bears at its upper end against an offset reset element 30. Reset element 30 is disposed so as to move freely alongside leaf springs 9 and 10 and it has a leg or end portion projecting out of the drawing plane which serves as a bracket for receiving the helical compression spring 32. The other end of compression spring 32 is applied against the housing bottom wall 33. Consequently, upon releasing the actuating member 26, following the actuation, the member is returned by spring 32 into an initial position and the reset element 30 brings the two leaf springs back into their initial position indicated in the drawing in solid lines. In so doing, the leaf springs are first stressed and then they snap back into their initial position only after the tension has attained a certain maximum value.

Return spring 32 is designed as a helical compression spring and it is guided in the sleeve-shape extension 34. This extension forms a stop 35 when contacts 16 and 18 are removed and in the position shown in the drawing, when contacts 16 and 18 are removed, the second arm portions 12, 12' would bear against the sides of the sleeve, which form stops 35.

While a specific embodiment of the invention has been shown and described in detail to illustrate the application of the principles of the invention, it will be understood that the invention may be embodied otherwise without departing from such principles.

What is claimed is:

1. An electrical switch, comprising a housing having spaced apart side walls each with a bearing recess, first and second laterally spaced fixed contacts located between said side walls, an actuator guided between said side walls for movement in directions toward and away from said fixed contacts, first and second substantially U-shape contact springs having first leg portions pivotally connected together, intermediate web portions pivoted in separate adjacent ones of said bearing recesses and second leg portions respectively movable toward and away from respective ones of said fixed contacts for electrical contact engagement therewith and in an opposite direction for disengagement therefrom, said actuator being movable through a path intercepting said first leg portions of said contact springs to flex said springs and thereafter pivot said intermediate portions in said bearing recesses and move said second leg portions.

2. An electrical switch, according to claim 1, including a stop spaced away from each of said fixed contacts, said second leg portions being engageable against respective ones of said stops in one of their switching positions.

3. An electrical switch, according to claim 1, including third and fourth spaced contacts spaced away from respective first and second fixed contacts, said second arm portions of said contact springs being located between respective first and third and second and fourth spaced apart fixed contacts.

4. An electrical switch, according to claim 1, wherein said first leg portions are curved and their free ends extend in respective opposite directions.

5. An electrical switch, according to claim 4, wherein said free ends are interengaged to form an edge bearing, said interengaged edge having interengageable teeth and recesses.

6. An electrical switch, according to claim 5, wherein the width of each end of said first portion of said contact springs is provided with a tooth on said first contact spring alignable with a recess on said second contact spring, said springs being of identical construction.

7. An electrical switch, according to claim 1, wherein said actuator is reciprocable in said housing, and a return spring acting on said actuator to return said actuator in a direction away from its actuating position.

8. An electrical switch, according to claim 1, wherein said first and second contact spring form a bistable snap mechanism, said actuating member comprising a member having at least a leg portion engageable with each of said first arm portions of said spring.

9. An electrical switch, according to claim 1, wherein said actuator includes a reset element extending around said first leg portions of said spring contacts and a biasing spring engaged against said reset element to urge it in a direction opposite to an actuation direction.

* * * * *